US008953955B2

(12) United States Patent
Kogusuri

(10) Patent No.: US 8,953,955 B2
(45) Date of Patent: Feb. 10, 2015

(54) IMAGE FORMING DEVICE, METHOD OF NOTIFYING CONSUMABLE EXHAUSTION, AND COMPUTER-READABLE STORAGE MEDIUM

(71) Applicant: Yuji Kogusuri, Kanagawa (JP)

(72) Inventor: Yuji Kogusuri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 7 days.

(21) Appl. No.: 13/944,061

(22) Filed: Jul. 17, 2013

(65) Prior Publication Data

US 2014/0023383 A1 Jan. 23, 2014

(30) Foreign Application Priority Data

Jul. 18, 2012 (JP) ..... 2012-159944
Jul. 9, 2013 (JP) ..... 2013-143690

(51) Int. Cl.
*G03G 15/00* (2006.01)
*G03G 15/08* (2006.01)

(52) U.S. Cl.
CPC ..... *G03G 15/553* (2013.01); *G03G 15/5079* (2013.01); *G03G 15/556* (2013.01)
USPC ..... 399/24; 399/27

(58) Field of Classification Search
USPC ..... 399/24, 27
See application file for complete search history.

(56) References Cited

U.S. PATENT DOCUMENTS 6,311,029 B1 * 10/2001 Sumio et al. ..... 399/82
8,228,526 B2 * 7/2012 Akimoto et al. ..... 358/1.14
2008/0025734 A1 * 1/2008 Kehoe et al. ..... 399/8

FOREIGN PATENT DOCUMENTS

JP 4019845 10/2007
JP 2009-037591 2/2009

* cited by examiner

*Primary Examiner* — G. M. Hyder
(74) *Attorney, Agent, or Firm* — Cooper & Dunham LLP

(57) ABSTRACT

An image forming device includes a calculation unit configured to calculate, based on attribute information of a print job, a supply time point at which supply of consumables becomes necessary due to execution of the print job; and a notification unit configured to notify a user of necessity of the supply of the consumables at a time point obtained by subtracting a transit time it takes for the user to move to the image forming device and a supply time necessary for supplying the consumables from the supply time point.

9 Claims, 9 Drawing Sheets

801 802 803 804

| USER NAME | EMAIL ADDRESS | DISTANCE (m) | CONSUMABLES MANAGER |
|---|---|---|---|
| SATOH | satoh@xxx.co.jp | 30 | |
| SUZUKI | suzuki@xxx.co.jp | 20 | |
| TAKAHASHI | takahashi@xxx.co.jp | 3 | ○ |

| 301 USER NAME | 302 EMAIL ADDRESS | 303 DISTANCE (m) |
|---|---|---|
| SATOH | satoh@xxx.co.jp | 30 |
| SUZUKI | suzuki@xxx.co.jp | 20 |
| TAKAHASHI | takahashi@xxx.co.jp | 3 |

FIG.4

| 401 PRINT JOB NAME | 402 USER NAME | 403 NUMBER OF PAGES | 404 NUMBER OF RENDERED PAGES | 405 NUMBER OF DISCHARGED PAGES | 406 PAPER FEED TRAY USED | 407 NUMBER OF REMAINING SHEETS IN PAPER FEED TRAY | 408 NUMBER OF PRINTABLE PAGES |
|---|---|---|---|---|---|---|---|
| A | SATO | 50 | 50 | 20 | TRAY 1 | 10 | 50 |
| B | SUZUKI | 20 | 0 | 0 | TRAY 1 | -1 | 10 |
| C | TAKAHASHI | 10 | 0 | 0 | TRAY 2 | -1 | 0 |

FIG.6

| 601 PRINT JOB NAME | 602 USER NAME | 603 NUMBER OF PAGES | 604 NUMBER OF RENDERED PAGES | 605 NUMBER OF DISCHARGED PAGES | 606 NUMBER OF DOTS TO BE TRANSFERRED | 607 AMOUNT OF REMAINING TONER (μl) | 608 NUMBER OF PRINTABLE PAGES |
|---|---|---|---|---|---|---|---|
| A | SATO | 50 | 50 | 20 | 52, 184, 160 | 250 | 50 |
| B | SUZUKI | 20 | 10 | 0 | 10, 436, 832 | -1 | 10 |
| C | TAKAHASHI | 10 | 0 | 0 | 0 | -1 | 0 |

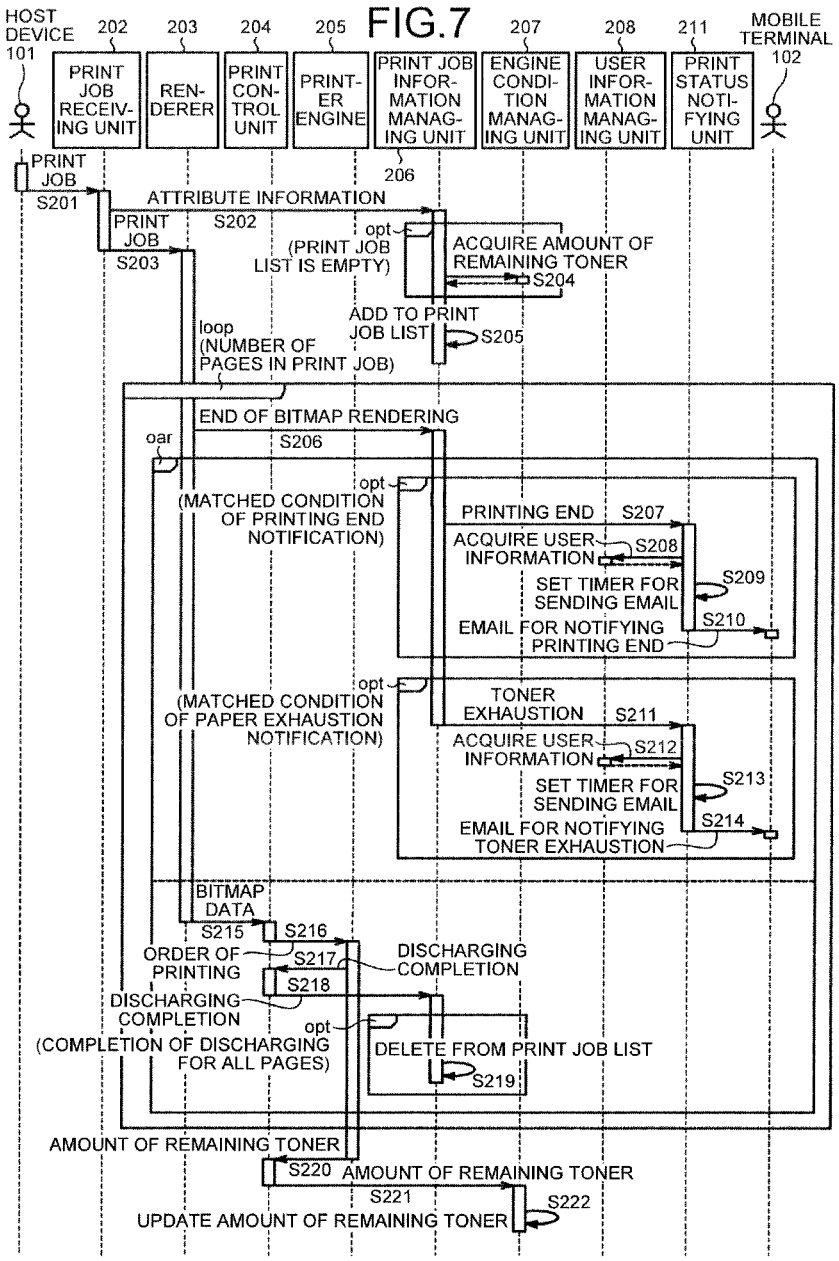
FIG.7
HOST DEVICE 101
202 PRINT JOB RECEIVING UNIT
203 RENDERER
204 PRINT CONTROL UNIT
205 PRINTER ENGINE
PRINT JOB INFORMATION MANAGING UNIT 206
207 ENGINE CONDITION MANAGING UNIT
208 USER INFORMATION MANAGING UNIT
211 PRINT STATUS NOTIFYING UNIT
MOBILE TERMINAL 102
PRINT JOB
S201
ATTRIBUTE INFORMATION
S202
PRINT JOB
S203
opt
(PRINT JOB LIST IS EMPTY)
ACQUIRE AMOUNT OF REMAINING TONER
S204
ADD TO PRINT JOB LIST
S205
loop
(NUMBER OF PAGES IN PRINT JOB)
END OF BITMAP RENDERING
S206
oar
opt
(MATCHED CONDITION OF PRINTING END NOTIFICATION)
PRINTING END
S207
ACQUIRE USER INFORMATION
S208
SET TIMER FOR SENDING EMAIL
S209
EMAIL FOR NOTIFYING PRINTING END
S210
opt
(MATCHED CONDITION OF PAPER EXHAUSTION NOTIFICATION)
TONER EXHAUSTION
S211
ACQUIRE USER INFORMATION
S212
SET TIMER FOR SENDING EMAIL
S213
EMAIL FOR NOTIFYING TONER EXHAUSTION
S214
BITMAP DATA
S215
S216
ORDER OF PRINTING
S217
DISCHARGING COMPLETION
S218
DISCHARGING COMPLETION
opt
(COMPLETION OF DISCHARGING FOR ALL PAGES)
DELETE FROM PRINT JOB LIST
S219
AMOUNT OF REMAINING TONER
S220
AMOUNT OF REMAINING TONER
S221
S222
UPDATE AMOUNT OF REMAINING TONER

FIG.8

| 801 | 802 | 803 | 804 |
|---|---|---|---|
| USER NAME | EMAIL ADDRESS | DISTANCE (m) | CONSUMABLES MANAGER |
| SATOH | satoh@xxx.co.jp | 30 | |
| SUZUKI | suzuki@xxx.co.jp | 20 | |
| TAKAHASHI | takahashi@xxx.co.jp | 3 | ○ |

IMAGE FORMING DEVICE, METHOD OF NOTIFYING CONSUMABLE EXHAUSTION, AND COMPUTER-READABLE STORAGE MEDIUM

CROSS-REFERENCE TO RELATED APPLICATIONS

The present application claims priority to and incorporates by reference the entire contents of Japanese Patent Application No. 2012-159944 filed in Japan on Jul. 18, 2012 and Japanese Patent Application No. 2013-143690 filed in Japan on Jul. 9, 2013.

BACKGROUND OF THE INVENTION

1. Field of the Invention

The present invention relates to an image forming device, a method of notifying consumable exhaustion, and a computer-readable storage medium.

2. Description of the Related Art

In an environment of sharing an image forming device among a plurality of users in an office, etc., some users cannot see the image forming device depending on the positional relation between the user and the image forming device. In such circumstances, it is desired that the time for which the user waits for the completion of printing after moving to the image forming device is as short as possible and that the user can collect the printout as fast as possible. For example, in a known system (see Japanese Laid-open Patent Publication No. 2004-058631), by measuring the distance from the user to the image forming device on the basis of the GPS (Global Positioning System) information, the time it takes for the user to reach the image forming device is calculated; at the time point obtained by subtracting the calculated time from the printing end time point, the printing end is notified to the user beforehand.

In a conventional method, however, the user is notified of just the printing end. Therefore, when the user has reached the image forming device after the reception of the notification, consumables such as paper or toner might be exhausted, in which case the user needs to supply the consumables. Since the printing is stopped during the supply of the consumables, it takes time further to complete the printing, which results in the lower productivity of printing.

Therefore, there is a need to provide a device and a method capable of preventing the productivity of printing from deteriorating.

SUMMARY OF THE INVENTION

It is an object of the present invention to at least partially solve the problems in the conventional technology.

According to an embodiment, there is provided an image forming device that includes a calculation unit configured to calculate, based on attribute information of a print job, a supply time point at which supply of consumables becomes necessary due to execution of the print job; and a notification unit configured to notify a user of necessity of the supply of the consumables at a time point obtained by subtracting a transit time it takes for the user to move to the image forming device and a supply time necessary for supplying the consumables from the supply time point.

According to another embodiment, there is provided a method of notifying consumable exhaustion executed in an image forming device. The method includes calculating, based on attribute information of a print job, a supply time point at which supply of consumables becomes necessary due to execution of the print job; and notifying a user of necessity of the supply of the consumables at a time point obtained by subtracting a transit time it takes for the user to move to the image forming device and a supply time necessary for supplying the consumables from the supply time point.

According to still another embodiment, there is provided a non-transitory computer-readable storage medium with an executable program stored thereon. The program instructs a computer to perform: calculating, based on attribute information of a print job, a supply time point at which supply of consumables becomes necessary due to execution of the print job; and notifying a user of necessity of the supply of the consumables at a time point obtained by subtracting a transit time it takes for the user to move to the image forming device and a supply time necessary for supplying the consumables from the supply time point.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 4 is a diagram for describing a print job list in the first embodiment;

FIG. 6 is a diagram for describing a print job list in a second embodiment;

FIG. 7 is a diagram for describing the sequence when an image forming device according to a second embodiment receives the print job;

FIG. 8 is a diagram for describing a configuration of user information in a third embodiment;

DETAILED DESCRIPTION OF THE PREFERRED EMBODIMENTS

Next, an image forming device according to an embodiment of the present invention is described. The image forming device calculates the time point (supply time point) at which the supply of consumables becomes necessary, and notifies a user of the necessity of the supply of the consumables at a time point obtained by subtracting a transit time it takes for the user to move to the image forming device and a supply time necessary for the supply of the consumables from the supply time point. Examples of the consumables include a recording medium for forming an image (such as paper), and toner. The consumables are not limited thereto, and may be staples, an ink cartridge, an ink ribbon, etc. In the examples described below, the consumables are paper or toner. When the consumables are paper, the time point of paper exhaustion (paper exhaustion time point) is an example of the supply time point. When the consumables are toner, the time point of toner exhaustion (toner exhaustion time point) is an example of the supply time point.

If a paper feed tray of the image forming device of this embodiment runs out of paper before the completion of the print job as a result of comparing the number of sheets of each print job and the number of remaining sheets in the paper feed tray, the image forming device notifies a user (a mobile terminal of the user) of the print job before the paper feed tray runs out of paper in consideration of the time it takes for the user to move to the image forming device, so that the user can supply the paper.

This embodiment is specifically described hereinafter with reference to the drawings.

First Embodiment

Figures 1, 2:
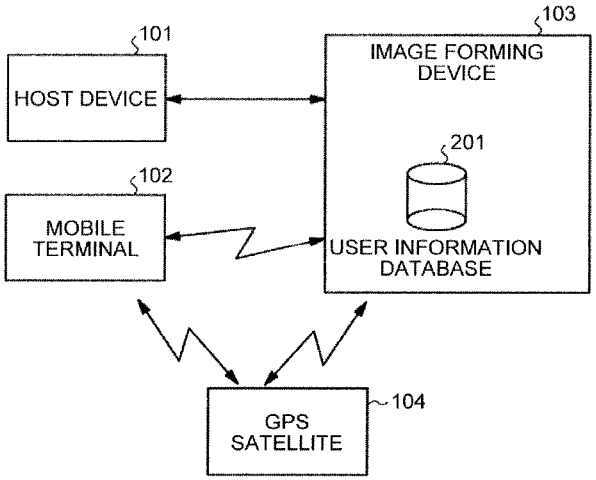
FIG. 1 is a schematic diagram of an image forming system including an image forming device according to a first embodiment.
FIG. 2 is a diagram depicting a configuration of user information in the first embodiment.

FIG. 1 is a schematic diagram depicting an image forming system including an image forming device of a first embodiment. The image forming system includes a host device 101, a mobile terminal 102, and an image forming device 103. The number of each of the host devices 101 and the mobile terminals 102 may be more than one. The host device 101 and the image forming device 103 are connected to each other via network such as LAN. The mobile terminal 102 and the image forming device 103 are connected to each other via wireless LAN, for example.

The host device 101 is, for example, a personal computer (PC) and transmits a print job to the image forming device 103. At the transmission of the print job, the host device 101 notifies information such as a print job name, a user name, the number of pages, and a paper feed tray to be used, as attribute information of the print job.

The mobile terminal 102 is a terminal owned by a user. The mobile terminal 102 has a function of transmitting and receiving email, and has a function of receiving email from the image forming device 103. The mobile terminal 102 has a function of acquiring positional information (latitude and longitude information) by receiving GPS signals of a GPS satellite 104. The mobile terminal 102 acquires the positional information from the GPS satellite 104 regularly, for example, and notifies the image forming device 103 of the email address and the positional information of the mobile terminal 102 itself.

The image forming device 103 includes a user information database 201, and has a function of acquiring the positional information (latitude and longitude information) by receiving the GPS signals from the GPS satellite 104. The user information database 201 is a database in which a user registers the user name and the address information (such as email address) of the mobile terminal 102.

Upon the reception of the print job from the host device 101, the image forming device 103 acquires the email address corresponding to the user name included in the attribute information of the print job with reference to the user information database 201. The image forming device 103 notifies the print status to the acquired email address. The timing of the notification is determined based on the distance calculated from the positional information of the image forming device 103 itself acquired from the GPS satellite 104 and the positional information of the mobile terminal 102 received from the mobile terminal 102 (the details are described later with reference to FIG. 2 to FIG. 5).

The positional information can be acquired by other method than the method using GPS. Any conventional method is applicable as long as the positions of the user and the image forming device 103 can be specified. For example, when the indoor GPS (IMES: Indoor Messaging System) can be used to acquire the positional information, the IMES can be applied.

FIG. 2 is a diagram illustrating the configuration of the user information in the first embodiment. The user information is the information related to the mobile terminal 102 owned by the user, and is stored in the user information database 201, for example. The user information includes a user name 301, an email address 302 as the address information, and a distance 303. The user name 301 is the name of a person who owns the mobile terminal 102, for example. The email address 302 is the email address of the mobile terminal 102, for example. The distance 303 is a distance from the image forming device 103 to the user (the mobile terminal 102 owned by the user). The unit of the distance is determined arbitrarily. In FIG. 2, the distance is expressed in units of meter.

Figure 3:
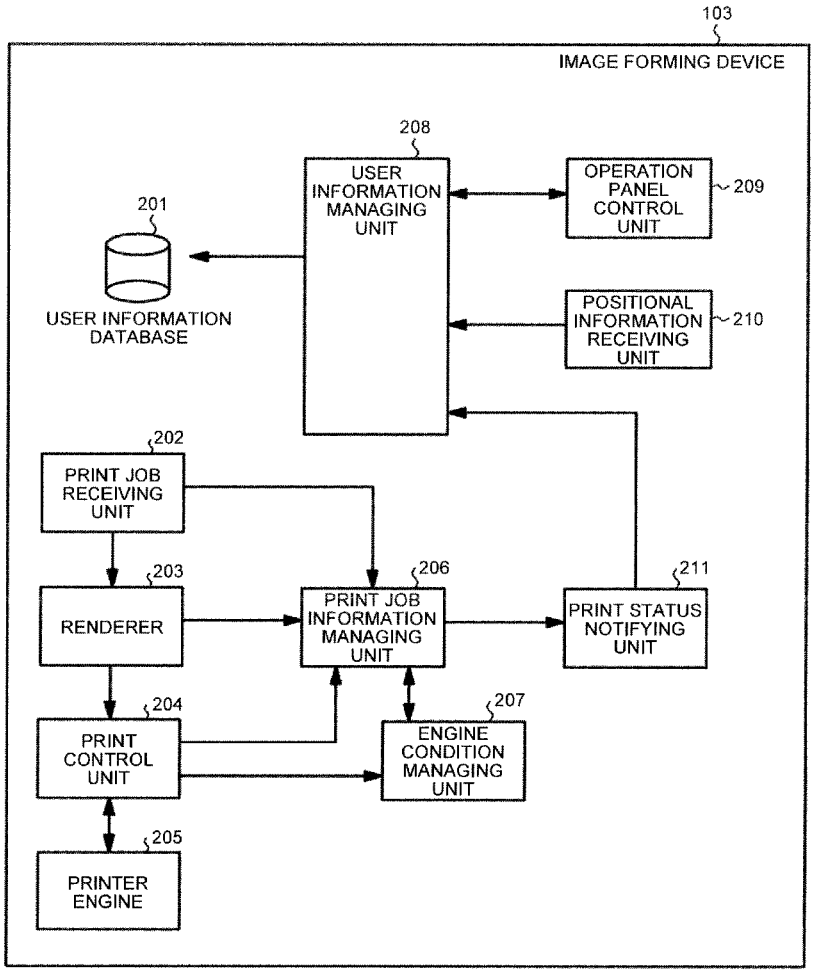
FIG. 3 is a schematic diagram of a configuration of the image forming device according to the first embodiment.

FIG. 3 is a schematic diagram of the configuration of the image forming device 103 of the first embodiment. As depicted in FIG. 3, the image forming device 103 includes a print job receiving unit 202, a renderer 203, a print control unit 204, a printer engine 205, a print job information managing unit 206, an engine condition managing unit 207, a user information managing unit 208, an operation panel control unit 209, a positional information receiving unit 210, and a print status notifying unit 211.

The print job receiving unit 202 receives a print job from the host device 101 or the like. Upon the reception of the print job from the host device 101, the print job receiving unit 202 first notifies the print job information managing unit 206 of the attribute information of the print job. The attribute information includes a print job name, a user name, the number of pages, and a paper feed tray used. The print job receiving unit 202 transfers the print job to the renderer 203.

The renderer 203 renders the image data whose print is specified by the print job, to a printable format. The renderer 203 converts the print job into, for example, a bitmap format, and every time the bitmap rendering of each page is completed, the renderer 203 notifies the print job information managing unit 206 of the end of the bitmap rendering and transfers the bitmap data to the print control unit 204; this process is repeated.

The print control unit 204 transfers the bitmap data to the printer engine 205, and performs printing by controlling the printer engine 205. Upon the reception of the discharging completion notification from the printer engine 205, the print control unit 204 transfers the discharging completion notification to the print job information managing unit 206 and the engine condition managing unit 207. Upon the reception of the notification of the number of remaining sheets in the paper feed tray from the printer engine 205, the print control unit 204 transfers the notification of the number of remaining sheets to the engine condition managing unit 207.

The printer engine 205 performs the printing in accordance with the order of the print control unit 204. The printer engine 205 transmits the discharging completion notification and the notification of the number of remaining sheets to the print control unit 204 as described above. The discharging completion notification is issued every time a sheet of paper is discharged, for example. The notification of the number of remaining sheets is issued when the device is activated or when the paper feed tray is closed, for example.

Based on the information received from the print job receiving unit 202, the renderer 203, the print control unit 204, and the engine condition managing unit 207, the print job information managing unit 206 creates a print job list and manages the value of each parameter of the print job list (here, the update of each parameter and the determination thereof are collectively referred to as management, and this also applies to the description below). The print job information managing unit 206 serves as a calculation unit for calculating the time points at which the print job ends and at which the paper feed tray runs out of paper, based on the value of each parameter of the print job list. The print job information managing unit 206 has a function of notifying the print status notifying unit 211 of the user name of the print job and the calculated paper exhaustion time point (the details are described later with reference to FIG. 4).

The engine condition managing unit 207 manages the number of remaining sheets for each tray on the basis of the notification of the number of remaining sheets and the discharging completion notification which are received from the print control unit 204. Upon the reception of the notification of the number of remaining sheets from the print control unit 204, the engine condition managing unit 207 notifies the print job information managing unit 206 of the content of the received notification.

Based on the information received from the operation panel control unit 209 and the positional information receiving unit 210, the user information managing unit 208 manages the user information illustrated in FIG. 2 (such as the user name, the email address of the mobile terminal of the user, and the distance). For example, the user information managing unit 208 stores and manages the user information input by the user using the operation panel control unit 209 in the user information database 201. If the user information managing unit 208 has received the distance between the user and the image forming device 103 from the positional information receiving unit 210, the user information managing unit 208 stores and manages the received distance in the user information database 201. The user information managing unit 208 reads in the user information from the user information database 201 at the time of startup. If there is a change in user information, the user information managing unit 208 updates the user information of the user information database 201.

Each component of the image forming device 103 can refer to the content of the user information database 201 via the user information managing unit 208.

The operation panel control unit 209 is an interface with a user, etc. A user can use the operation panel control unit 209 to register, change, delete, and refer to the information such as the user name 301 and the email address 302. Upon the reception of the registration, change, or deletion of the user name 301 and the email address 302, the operation panel control unit 209 notifies the user information managing unit 208 of the user name 301 and the email address 302.

The positional information receiving unit 210 receives the positional information indicating the position of a user. The positional information receiving unit 210 receives the positional information of the image forming device 103 from the GPS satellite 104 at the startup, for example. After the startup, the positional information receiving unit 210 receives the email address 302 and the positional information from the mobile terminal 102 of the user. The positional information receiving unit 210 calculates the distance 303 between the image forming device 103 and the mobile terminal 102 using the positional information received from each of the image forming device 103 and the mobile terminal 102. The positional information receiving unit 210 notifies the user information managing unit 208 of the calculated distance 303 and the email address 302. Note that the timing at which the positional information receiving unit 210 receives the positional information is determined arbitrarily. For example, the positional information receiving unit 210 may receive the positional information regularly, or may receive the positional information when the calculation of each time point (printing end time point, paper exhaustion time point) is needed.

The print status notifying unit 211 serves as a notification unit that notifies the print status that, for example, the supply of the consumables is necessary. Upon the reception of the user name of the print job and the time point at which the print job ends or the time point at which the paper feed tray runs out of paper from the print job information managing unit 206, the print status notifying unit 211 acquires the user information corresponding to the user name of the print job from the user information managing unit 208.

When the print status notifying unit 211 has received the notification of the end of the print job from the print job information managing unit 206, the transit time it takes for the user to move to the image forming device 103 is calculated based on the distance 303 of the user information acquired via the user information managing unit 208. The transit time can be calculated based on, for example, the distance 303 and predetermined walking speed of the user. At the time point obtained by reducing (subtracting) the transit time from the time point at which the print job ends, which is received from the print job information managing unit 206, the print status notifying unit 211 sends the email notifying the printing end to the email address of the acquired user information.

When the print status notifying unit 211 has received the notification of the paper exhaustion of the paper feed tray (paper exhaustion time point) from the print job information managing unit 206, the print status notifying unit 211 sends the email notifying the paper exhaustion to the email address 302 of the user information acquired from the user information managing unit 208 at the time point obtained by subtracting the transit time of the user and the time required for supplying the paper to the paper feed tray (supply time) from the received paper exhaustion time point. The user having received the email goes to the image forming device 103 to supply paper.

The notification method by the print status notifying unit 211 is not limited to the email, and any other method is applicable as long as the user can be notified of the printing end and the paper exhaustion.

FIG. 4 is a diagram for describing the print job list in the first embodiment. The print job list is, as described above, the information configured based on the information received from the print job receiving unit 202, the renderer 203, the print control unit 204, and the engine condition managing unit 207 by the print job information managing unit 206. The print job list is formed by arranging the print job information. The print job information includes parameters of a print job name 401, a user name 402, the number 403 of pages, the number 404 of rendered pages, the number 405 of discharged pages, a paper feed tray 406 to be used, the number 407 of remaining sheets in a paper feed tray, and the number 408 of printable sheets.

Upon the reception of the notification of the attribute information of the print job from the print job receiving unit 202, the print job information managing unit 206 adds the print job information at the bottom of the print job list and sets each parameter value as below. In other words, the print job information managing unit 206 sets the values of the print job name 401, the user name 402, the number 403 of pages, and the paper feed tray 406 with the values of the attribute information of the received print job as fixed values. The print job information managing unit 206 sets the default values of the number 404 of rendered pages and the number 405 of discharged pages to 0. When the print job information managing unit 206 has received the notification of the end of the bitmap rendering from the renderer 203, the number 404 of rendered pages is increased by one. When the print job information managing unit 206 has received the notification of the discharging completion from the print control unit 204, the number 405 of discharged pages is increased by one.

The value of the number 407 of remaining sheets in the paper feed tray corresponds to the number of remaining sheets at the time when the printing of the print job ends. The value of the number 407 of remaining sheets in the paper feed tray can be calculated based on the number of remaining sheets in the paper feed tray acquired from the engine condition managing unit 207 and the number 403 of pages of the print job and the preceding print job information. If the paper feed tray runs out of paper during the execution of the print job or the preceding print job, the print job information managing unit 206 sets the value of the number 407 of remaining sheets in the paper feed tray to −1. The value of the number 408 of printable pages represents the number of pages on which printing is possible without the paper feed tray running out of paper. If printing can be performed on all the pages without the paper feed tray running out of paper, the value of the number 408 of printable pages is the same as the value of the number 403 of pages as a matter of course. The value of the number 408 of printable pages can be calculated from the number of remaining sheets in the paper feed tray acquired from the engine condition managing unit 207 and the number 403 of pages of the print job and the preceding print job information.

In this embodiment, when the notification of the end of the bitmap rendering has been received from the renderer 203 by determining the presence or absence of the notification of the end of the bitmap rendering from the renderer 203, the print job information managing unit 206 determines the condition of the printing end notification and the condition of the paper exhaustion notification of the paper feed tray by the following method.

In other words, the print job information managing unit 206 determines that the condition of the printing end notification is established when the value of the number 407 of remaining sheets in the paper feed tray is other than −1 and when the total value of the number 404 of rendered pages of the first print job to the print job in the print job list is equal to the total value of the number 408 of printable pages. When the condition of the printing end notification has been matched (established), the print job information managing unit 206 subtracts the total value of the number 405 of discharged pages from the total value of the number 408 of printable pages of the first print job to the print job in the print job list, so that the number of non-discharged pages is acquired. The print job information managing unit 206 calculates the time point at which the print job ends, based on the number of non-discharged pages and the print speed of the printer engine 205. The print job information managing unit 206 notifies the print status notifying unit 211 of the user name 402 of the print job information and the time point at which the print job ends. The print job information managing unit 206 calculates the time point at which the print job ends, by using the value of predetermined print speed per page as the print speed of the printer engine 205.

The print job information managing unit 206 determines that the condition of the paper exhaustion notification is established when the value of the number 407 of remaining sheets in the paper feed tray is −1 and when the total value of the number 404 of rendered pages of the first print job to the print job in the print job list is the same as the total value of the number 408 of printable pages (when the total of the number 404 of rendered pages is equal to the value of the number 408 of printable pages, the time point when the final printing ends before the paper exhaustion is determined, so that the paper exhaustion can be notified finally at this point. Therefore, the time point at which the final printing ends cannot be determined before the match).

When the condition of the paper exhaustion notification has been matched (that is, the notification condition has been established), the print job information managing unit 206 subtracts the total value of the number 405 of discharged pages from the total value of the number 408 of printable pages of the first print job to the print job in the print job list, and acquires the number of non-discharged pages. The print job information managing unit 206 calculates the time point (paper exhaustion time point) at which the paper feed tray runs out of time based on the number of non-discharged pages and the print speed of the printer engine 205. The print job information managing unit 206 notifies the print status notifying unit 211 of the user name 402 of the print job information and the calculated paper exhaustion time point.

Next, as for the print job list, an example in which the image forming device 103 has received three print jobs with print job names A, B, and C for single-sided printing is described. Here, the number of remaining sheets in the paper feed tray before the reception of the print jobs is 60 in a tray 1 and 100 in a tray 2.

FIG. 4 depicts the state of the print job list in which after the reception of the print job names A, B, and C, the number 404 of rendered pages is 50 and the number 405 of discharged pages is 20 in the print job of the print job name A.

Upon the reception of the notification of the attribute information of the print job name A, the print job information managing unit 206 acquires the number of remaining sheets in each tray from the engine condition managing unit 207. The tray 1 contains 60 sheets of paper, and since the print job of the print job name A uses 50 sheets of paper from the tray 1, the print job information managing unit 206 sets the value of the number 407 of remaining sheets of paper to 10. The print job information managing unit 206 sets the value of the number 408 of printable sheets to 50.

At the time of reception of the print job of the print job name B, it is known that 10 sheets of paper are left in the tray 1 at the end of the print job of the print job name A. The print job of the print job name B uses 20 sheets of paper from the tray 1. Therefore, when 10 pages are printed, the tray 1 runs out of paper. In view of this, the print job information managing unit 206 sets the value of the number 407 of remaining sheets in the tray to −1.

The print job information managing unit 206 sets the value of the number 408 of printable sheets to 10, which is the same as the number of remaining sheets in the paper feed tray.

At the time of reception of the print job of the print job name C, it is known that the tray runs out of paper during the execution of the preceding print job of the print job name B. Therefore, the print job information managing unit 206 sets the value of the number 407 of remaining sheets to −1 regardless of the number of remaining sheets in the tray 2. The print job information managing unit 206 sets the value of the number 408 of printable sheets to 0.

Here, as for the print job name A, the number 407 of remaining sheets in the tray of the print job of the print job name A is not −1. Therefore, when the number 404 of rendered pages of the print job of the print job name A has reached 50, which is the same as the value of the number 408 of printable pages of the print job of the print job name A, the print job information managing unit 206 calculates the end time point based on the number of non-discharged pages and the print speed of the printer engine 205. Then, the print job information managing unit 206 notifies the print status notifying unit 211 of the user name 402 of the print job information of the print job name A and the time point at which the print job ends.

As for the print job name B, the number 407 of remaining sheets in the tray of the print job of the print job name B is −1. Therefore, when the value of the number 404 of rendered pages of the print jobs of the print job name A and the print job name B has reached 60, which is the same as the total of the number 408 of printable pages of the print jobs of the print job name A and the print job name B, the print job information managing unit 206 calculates the time point at which the paper feed tray runs out of paper (paper exhaustion time point) on the basis of the number of non-discharged pages and the print speed of the printer engine 205. Then, the print job information managing unit 206 notifies the print status notifying unit 211 of the user name 402 of the print job information of the print job name B and the paper exhaustion time point.

As for the print job name C, the number 407 of remaining sheets in the paper feed tray of the print job of the print job name C is −1. Therefore, when the value of the number 404 of rendered pages of the print jobs of the print job name A to the print job name C has reached 60, which is the same as the total of the number 408 of printable pages of the print jobs of the print job name A to the print job name C, the print job information managing unit 206 calculates the time point at which the tray runs out of paper (paper exhaustion time point) on the basis of the number of non-discharged pages and the print speed of the printer engine 205. Then, the print job information managing unit 206 notifies the print status notifying unit 211 of the user name 402 of the print job information of the print job name C and the paper exhaustion time point.

In the above example, the users of the print job name B and the print job name C are notified of the paper exhaustion. The user of the print job name A is notified of the printing end. In this example, the user of the print job using the other paper feed tray than the paper feed tray running out of paper is notified of the paper exhaustion; however, only the user of the print job using the paper feed tray running out of paper may be notified of the paper exhaustion. For example, unnecessary notification can be suppressed if the image forming device 103 has a function of, in the occurrence of the paper exhaustion in a certain paper feed tray, continuing printing in another paper feed tray.

Figure 5:
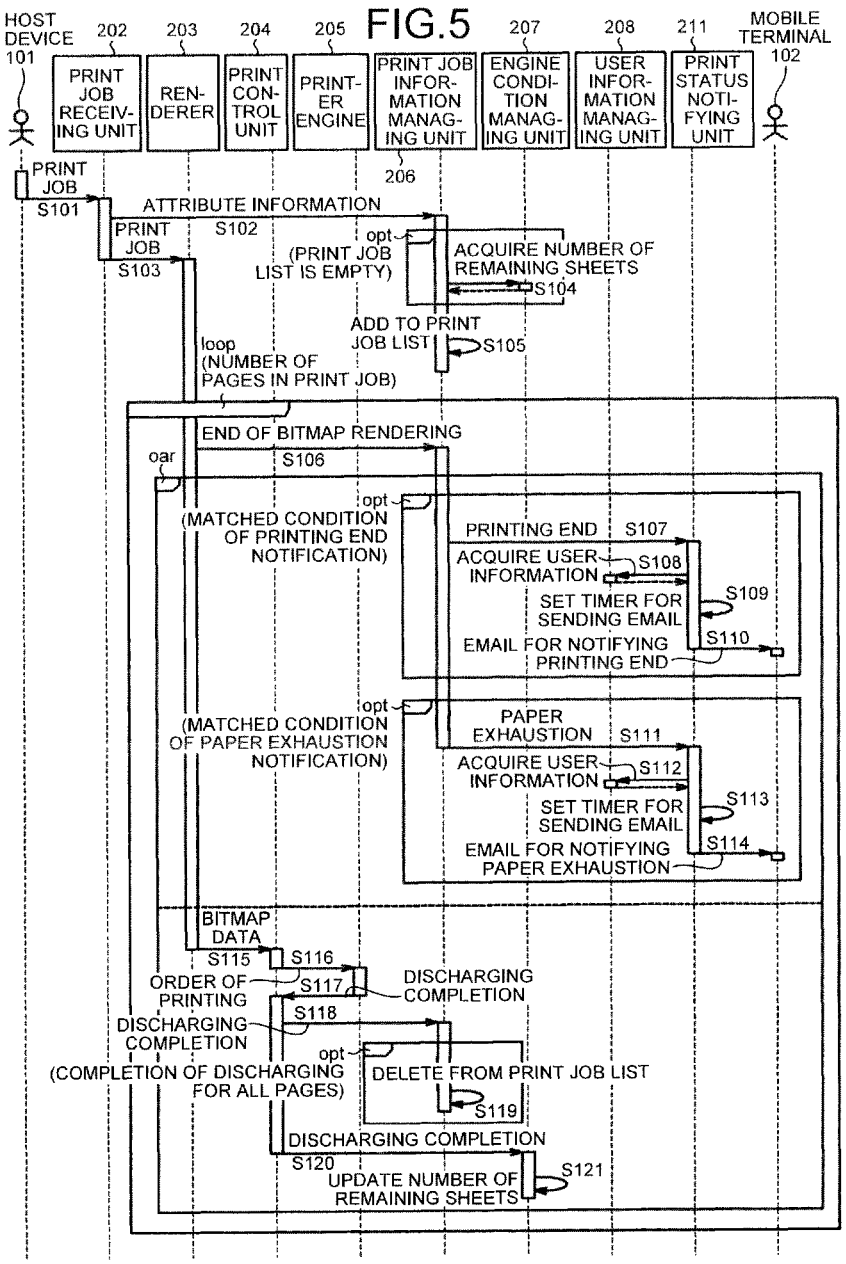
FIG. 5 is a diagram for describing the sequence (order of operation) when the image forming device of the first embodiment receives the print job.

FIG. 5 is a diagram for describing the sequence (order of operation) when the image forming device 103 of the first embodiment receives the print job.

Upon the reception of the print job from the host device 101 (Step S101), the print job receiving unit 202 notifies the print job information managing unit 206 of the attribute information of the print job (Step S102) and transfers the print job to the renderer 203 (Step S103).

Upon the reception of the attribute information, the print job information managing unit 206 acquires the number of remaining sheets from the engine condition managing unit 207 (Step S104) if the print job list is empty, and adds the print job information to the print job list of FIG. 4 (Step S105). If the print job list is not empty, the print job information managing unit 206 adds the print job information to the print job list of FIG. 4 with reference to the print job list and the number of remaining sheets acquired when the print job list is empty (Step S105).

Upon the reception of the print job, the renderer 203 notifies the print job information managing unit 206 of the end of the bitmap rendering every time bitmap rendering for one page ends (Step S106), and transfers the bitmap data to the print control unit 204 (Step S115). The renderer 203 repeats this process by the number of pages of the print job. Every time the notification of the end of the bitmap rendering is received, the print job information managing unit 206 increases the number 404 of rendered pages of the print job list. In accordance with the procedure described in relation to FIG. 4, the print job information managing unit 206 determines whether the condition of the printing end notification and the condition of the paper exhaustion notification are established or not. When the condition of the printing end notification is established, the print job information managing unit 206 notifies the print status notifying unit 211 of the printing end together with the user name 402 of the print job and the printing end time point (Step S107). When the condition of the paper exhaustion notification is established, the print job information managing unit 206 notifies the print status notifying unit 211 of the paper exhaustion together with the user name 402 of the print job and the paper exhaustion time point (Step Sill).

Upon the reception of the printing end notification, the print status notifying unit 211 acquires the user information having the user name 301 matching the user name 402 of the print job information included in the printing end notification, from the user information managing unit 208 (Step S108). Next, based on the distance 303 of the acquired user information, the print status notifying unit 211 calculates the transit time it takes for the user to move to the image forming device 103. The print status notifying unit 211 sets the email sending timer so that the time is up at the time point obtained by subtracting the transit time from the printing end time point included in the printing end notification (Step S109). When the time is up, the print status notifying unit 211 sends email to the mobile terminal 102 to notify the printing end (Step S110).

Upon the reception of the paper exhaustion notification, the print status notifying unit 211 acquires the user information having the user name 301 matching the user name 402 of the print job information included in the paper exhaustion notification, from the user information managing unit 208 (Step S112). Next, the print status notifying unit 211 calculates the transit time to the image forming device 103 based on the distance 303 of the acquired user information. The print status notifying unit 211 sets the email sending timer so that the time is up at the time point obtained by subtracting the transit time and the time for supplying paper into the paper feed tray from the paper exhaustion time point included in the paper exhaustion notification (Step S113). When the time is up, the print status notifying unit 211 sends email to the mobile terminal 102 of the user to notify the paper exhaustion (Step S114).

Upon the reception of the bitmap data from the renderer 203, the print control unit 204 transfers the bitmap data to the printer engine 205 and performs printing by controlling the printer engine 205 (Step S116). The printer engine 205 performs printing in accordance with the order of the print control unit 204 and every time one sheet of paper is discharged, the printer engine 205 notifies the print control unit 204 of the discharging completion (Step S117). Upon the reception of the notification of the discharging completion, the print control unit 204 transfers the notification of the discharging completion to the print job information managing unit 206 (Step S118) and also transfers the notification of the discharging completion to the engine condition managing unit 207 (Step S120).

Upon the reception of the notification of the discharging completion from the print control unit 204, the print job information managing unit 206 increases the number 405 of discharged pages in the print job list. When the number 405 of discharged pages is equal to the number 403 of pages, the print job information managing unit 206 deletes the print job information from the print job list (Step S119). Upon the reception of the notification of the discharging completion, the engine condition managing unit 207 updates the number of remaining sheets by decreasing the number of remaining sheets in the corresponding tray (Step S121).

Second Embodiment

A second embodiment describes an example in which the consumables are toner. The configuration of the image forming system and the configuration of the user information according to the second embodiment are the same as those of the first embodiment. Thus, the different point of the configuration of the image forming device 103 in the second embodiment from the first embodiment is described below.

The renderer 203 counts the number of dots to be transferred for each color to be rendered on each page when the print job is converted into bitmap, and notifies the print job information managing unit 206 of the number of dots to be transferred for each color together with the end of the bitmap rendering.

Upon the reception of the notification of the amount of remaining toner for each color from the printer engine 205, the print control unit 204 transfers the notification of the amount of remaining toner to the engine condition managing unit 207. The printer engine 205 notifies the print control unit 204 of the amount of remaining toner for each color. The print control unit 204 issues the notification of the amount of remaining toner at the time of, for example, startup, toner supply, and printing stop.

The print job information managing unit 206 calculates the toner exhaustion time point for each color on the basis of each parameter value of the print job list. The print job information managing unit 206 notifies the print status notifying unit 211 of the notification of the toner exhaustion for each color together with the user name of the print job and the toner exhaustion time point for each color (details are described later with reference to FIG. 6).

The engine condition managing unit 207 holds the information indicating the amount of remaining toner (toner remaining amount information) for each color notified by the print control unit 204. Upon the reception of the toner exhaustion notification from the print job information managing unit 206, the print status notifying unit 211 acquires the user information corresponding to the user name of the print job from the user information managing unit 208. The print status notifying unit 211 calculates the transit time it takes for the user to move to the image forming device 103 on the basis of the distance 303 of the acquired user information. The print status notifying unit 211 sends email notifying the toner exhaustion to the email address 302 of the acquired user information at the time point obtained by subtracting the transit time and the toner supply time from the time point (toner exhaustion time point) received from the print job information managing unit 206.

FIG. 6 is a diagram for describing the print job list in the second embodiment. In this embodiment, the printer is a monochrome printer and toner of one black color is used. The toner exhaustion occurs in the printing of the 10th page in the print job name B after receiving the print jobs of the print job names A, B, and C.

FIG. 6 depicts the state of the print job list when the toner exhaustion is detected in advance after the end of the bitmap rendering of the 10th page of the print job name B. The print job list is formed by arranging the print job information. The print job information includes parameters of a print job name 601, a user name 602, the number 603 of pages, the number 604 of rendered pages, the number 605 of discharged pages, the number 606 of dots to be transferred, the amount 607 of remaining toner, and the number 608 of printable sheets.

Upon the reception of the notification of the attribute information of the print job from the print job receiving unit 202, the print job information managing unit 206 adds the print job information at the bottom of the print job list and sets each parameter value of the print job list as below.

In other words, the print job information managing unit 206 sets the print job name 601, the user name 602, the number 603 of pages, the number 604 of rendered pages, and the number 605 of discharged pages in a manner similar to the first embodiment. The print job information managing unit 206 sets the default value of the number 606 of dots to be transferred to 0, and every time the notification of the end of the bitmap rendering is received from the renderer 203, adds the number of dots to be transferred included in the notification. If the print job list is empty, the print job information managing unit 206 acquires the amount of remaining toner from the engine condition managing unit 207 and sets the acquired value as the default value of the amount 607 of remaining toner. If the print job list is not empty, the print job information managing unit 206 sets NULL as the default value. The print job information managing unit 206 sets the value of the amount 607 of remaining toner of the print job information, which is previous to the print job when the conversion (rendering) of the preceding print job ends for all pages. In any case, after that, every time the notification of the end of the bitmap rendering is received from the renderer 203, the print job information managing unit 206 converts the number of dots to be transferred included in the notification into the amount of toner consumed at the transfer, and subtracts the amount of toner obtained by the conversion from the amount 607 of remaining toner. For example, the print job information managing unit 206 converts the number of dots to be transferred into the amount of toner by multiplying the predetermined amount of toner required for transfer of one dot by the number of dots to be transferred. If the amount of remaining toner is less than 0, the print job information managing unit 206 sets −1.

The print job information managing unit 206 sets 0 as the default value of the number 608 of printable pages. If the amount 607 of remaining toner is not −1 at the update of the value of the amount 607 of remaining toner upon the reception of the notification of the end of the bitmap rendering from the renderer 203, the print job information managing unit 206 adds 1 to the number 608 of printable pages. When the amount 607 of remaining toner becomes −1, the print job information managing unit 206 maintains the value of the number 608 of printable pages. If all the pages can be printed without the occurrence of toner exhaustion, the value of the number 608 of printable pages is equal to the value of the number 603 of pages.

For updating the value of the amount 607 of remaining toner upon the reception of the notification of the end of the bitmap rendering from the renderer 203, the print job information managing unit 206 determines the condition of the toner exhaustion notification when the amount 607 of remaining toner becomes −1. Upon the match with the predetermined condition of the toner exhaustion notification (i.e., when the total of the number 604 of rendered pages is equal to the value of the number 608 of printable pages), the print job information managing unit 206 obtains the number of non-discharged pages by subtracting the total value of the number 605 of discharged pages from the total value of the number 608 of printable pages of the first print job to the print job in the print job list. The print job information managing unit 206 calculates the toner exhaustion time point on the basis of the number of non-discharged pages and the print speed of the printer engine 205, and notifies the print status notifying unit 211 of the user name 602 of the print job information and the toner exhaustion time point.

FIG. 7 is a diagram for describing the sequence when the image forming device 103 of the second embodiment receives the print job. Steps S201 to S203 are the same as Steps S101 to S103 of the first embodiment.

Upon the reception of the print job from the host device 101 (Step S201), the print job receiving unit 202 notifies the print job information managing unit 206 of the attribute information of the print job (Step S202) and transfers the print job to the renderer 203 (Step S203).

Upon the reception of the attribute information, the print job information managing unit 206 acquires the amount of remaining toner from the engine condition managing unit 207 (Step S204) if the print job list is empty, and adds the print job information to the print job list by the procedure described in relation to FIG. 6 (Step S205). If the print job list is not empty, the print job information managing unit 206 adds the print job information to the print job list by the procedure described in relation to FIG. 6 with reference to the print job list and the amount of remaining toner acquired when the print job list is empty (Step S205).

Upon the reception of the print job, the renderer 203 notifies the print job information managing unit 206 of the end of the bitmap rendering together with the number of dots to be transferred every time the bitmap rendering for one page ends (Step S206), and transfers the bitmap data to the print control unit 204 (Step S215). The renderer 203 repeats this process by the number of pages of the print job.

Steps S207 to S210 are the same as Steps S107 to S110 of the first embodiment. When the condition of the printing end notification is established, the print job information managing unit 206 sends the notification of the printing end together with the user name 602 of the print job and the printing end time point to the print status notifying unit 211 (Step S207).

Upon the reception of the printing end notification, the print status notifying unit 211 acquires the user information having the user name 301 matching the user name 602 of the print job information included in the printing end notification, from the user information managing unit 208 (Step S208).

Next, based on the distance 303 of the acquired user information, the print status notifying unit 211 calculates the transit time it takes for the user to move to the image forming device 103. The print status notifying unit 211 sets the email sending timer so that the time is up at the time point obtained by subtracting the transit time from the printing end time point included in the printing end notification (Step S209). When the time is up, the print status notifying unit 211 sends email to the mobile terminal 102 to notify the printing end (Step S210).

Upon the reception of the notification of the end of the bitmap rendering, the print job information managing unit 206 increases the number 604 of rendered pages of the print job list. In accordance with the procedure described in relation to FIG. 6, the print job information managing unit 206 determines the condition of toner exhaustion notification. When the condition of the toner exhaustion notification is established, the print status notifying unit 211 is notified of the toner exhaustion together with the user name 602 of the print job and the toner exhaustion time point (Step S211).

Upon the reception of the toner exhaustion notification, the print status notifying unit 211 acquires the user information having the user name 301 matching the user name 602 of the print job information included in the toner exhaustion notification, from the user information managing unit 208 (Step S212). Next, based on the distance 303 of the acquired user information, the print status notifying unit 211 calculates the transit time it takes for the user to move to the image forming device. The print status notifying unit 211 sets the email sending timer so that the time is up at the time point obtained by subtracting the transit time and the toner supply time from the toner exhaustion time point included in the toner exhaustion notification (Step S213). When the time is up, the print status notifying unit 211 sends email to the mobile terminal 102 to notify the toner exhaustion (Step S214).

Steps S216 to S219 are the same as Steps S116 to S119 of the first embodiment. Upon the reception of the bitmap data, the print control unit 204 transfers the bitmap data to the printer engine 205 and performs printing by controlling the printer engine 205 (Step S216). The printer engine 205 performs printing in accordance with the order of the print control unit 204 and every time one sheet of paper is discharged, the printer engine 205 notifies the print control unit 204 of the discharging completion (Step S217). Upon the reception of the notification of the discharging completion, the print control unit 204 transfers the notification of the discharging completion to the print job information managing unit 206 (Step S218).

Upon the reception of the notification of the discharging completion, the print job information managing unit 206 increases the number 605 of discharged pages in the print job list. When the number 605 of discharged pages is equal to the number 603 of pages, the print job information managing unit 206 deletes the print job information from the print job list (Step S219). When the printing stops, the printer engine 205 notifies the print control unit 204 of the amount of remaining toner (Step S220).

Upon the reception of the notification of the amount of remaining toner, the print control unit 204 transfers the notification of the amount of remaining toner to the engine condition managing unit 207 (Step S221). Upon the reception of the notification of the amount of remaining toner, the engine condition managing unit 207 updates the information on the amount of remaining toner, which is held (Step S222).

Third Embodiment

In the first embodiment and the second embodiment, the user transmitting the print job (user requesting the execution of the print job) is the target of each notification; however, the target of the notification is not limited to this. The third embodiment describes an example in which the notification is transmitted to a predetermined user who manages the consumables (consumables manager).

The configuration of the image forming system of the third embodiment, mainly the different point from the first embodiment, is described below. The user information database 201 is a database in which the user name, the address information (such as email address) of the mobile terminal 102, and the consumables manager are registered by a user. When the exhaustion of consumables such as paper or toner is detected beforehand, the image forming device 103 acquires the email address of the consumables manager registered in the user information database 201 and notifies the status of the consumable exhaustion to the acquired email address.

The timing of the notification is determined, in a manner similar to the first embodiment, based on the distance calculated from the positional information of the image forming device 103 acquired from the GPS satellite 104 and the positional information of the mobile terminal 102 received from the mobile terminal 102.

FIG. 8 is a diagram for describing the configuration of the user information in the third embodiment. The user information is the information related to the mobile terminal 102, and is stored in the user information database 201, for example. The user information includes a user name 801, an email address 802 of the user, a distance 803, and a consumables manager 804. The user name 801, the email address 802, and the distance 803 are the same as those of the first embodiment. The consumables manager 804 is the information indicating whether he/she is the operator who supplies the consumables such as paper or toner on exhaustion. In FIG. 8, a circular mark indicates the consumables manager. The number of consumables managers may be more than one.

The configuration of the image forming device 103 of the third embodiment, mainly the different point from the first embodiment, is described below.

The operation panel control unit 209 is the interface with the user. The user can use the operation panel control unit 209 to register, change, delete, and refer to the pieces of information such as the user name 801, the email address 802, and the consumables manager 804. Upon the reception of the registration, change, or deletion of the user name 801, the email address 802, and the consumables manager 804, the operation panel control unit 209 notifies the user information managing unit 208 of the user name 801, the email address 802 and the consumables manager 804.

Upon the reception of the consumable exhaustion notification such as paper or toner exhaustion from the print job information managing unit 206, the print status notifying unit 211 acquires the user information of the consumables manager from the user information managing unit 208. The print status notifying unit 211 sends email notifying the consumable exhaustion to the email address 802 of the acquired user information at the time point obtained by subtracting the transit time it takes for the consumables manager to move to the image forming device 103 and the consumables supply time from the consumable exhaustion time point received from the print job information managing unit 206. If the number of consumables managers is more than one, the email is sent to all of the managers.

The configuration of the print job list in the third embodiment is the same as that of the first embodiment.

The sequence of the image forming device 103 at the time of receiving the print job in the third embodiment is similar to that of the first embodiment.

Fourth Embodiment

A fourth embodiment describes an example in which the notification is sent to a user who is closest to the image forming device 103. The configuration of an image forming system of the fourth embodiment, mainly the different point from the first embodiment, is described below.

The image forming device 103 includes the user information database 201. The user information database 201 is a database in which a user registers the user name and the address information (such as email address) of the mobile terminal 102.

When the exhaustion of consumables such as paper or toner is detected beforehand, the image forming device 103 acquires the email address of the user closest to the image forming device from among the users registered in the user information database 201 and notifies the status of the consumables to the mobile terminal 102 of the user.

The configuration of the image forming device 103 of the fourth embodiment, mainly the different point from the first embodiment, is described below.

Upon the reception of the consumable exhaustion such as paper or toner exhaustion from the print job information managing unit 206, the print status notifying unit 211 acquires the user information with the smallest value of the distance 303 of the user information. At the time point obtained by subtracting the transit time it takes for the user (user with the smallest value of the distance 303) included in the acquired user information to move to the image forming device 103 and the time for supplying consumables from the consumable exhaustion time point received from the print job information managing unit 206, the print status notifying unit 211 sends email notifying the consumable exhaustion to the email address 302 of the user with the smallest value of the distance 303.

The configuration of the print job list in the fourth embodiment and the sequence of the image forming device 103 at the time of receiving the print job in the fourth embodiment are similar to those of the first embodiment.

The timing of the notification is determined, in a manner similar to the first embodiment, based on the distance calculated from the positional information of the image forming device 103 acquired from the GPS satellite 104 and the positional information of the mobile terminal 102 of the user received from the mobile terminal 102.

As thus described, according to this embodiment, even though the user transmitting the print job is away from the image forming device, it is possible to know the consumable exhaustion such as paper exhaustion or toner exhaustion of the image forming device beforehand and to notify the mobile terminal of the user. Therefore, the possibility of supplying consumables without stopping the printing can be increased. When the mobile terminal is notified, the email can also be sent to the other users than the user executing the print job, such as the consumables manager. This can increase the possibility of exchanging the consumables without stopping the printing.

Figure 9:
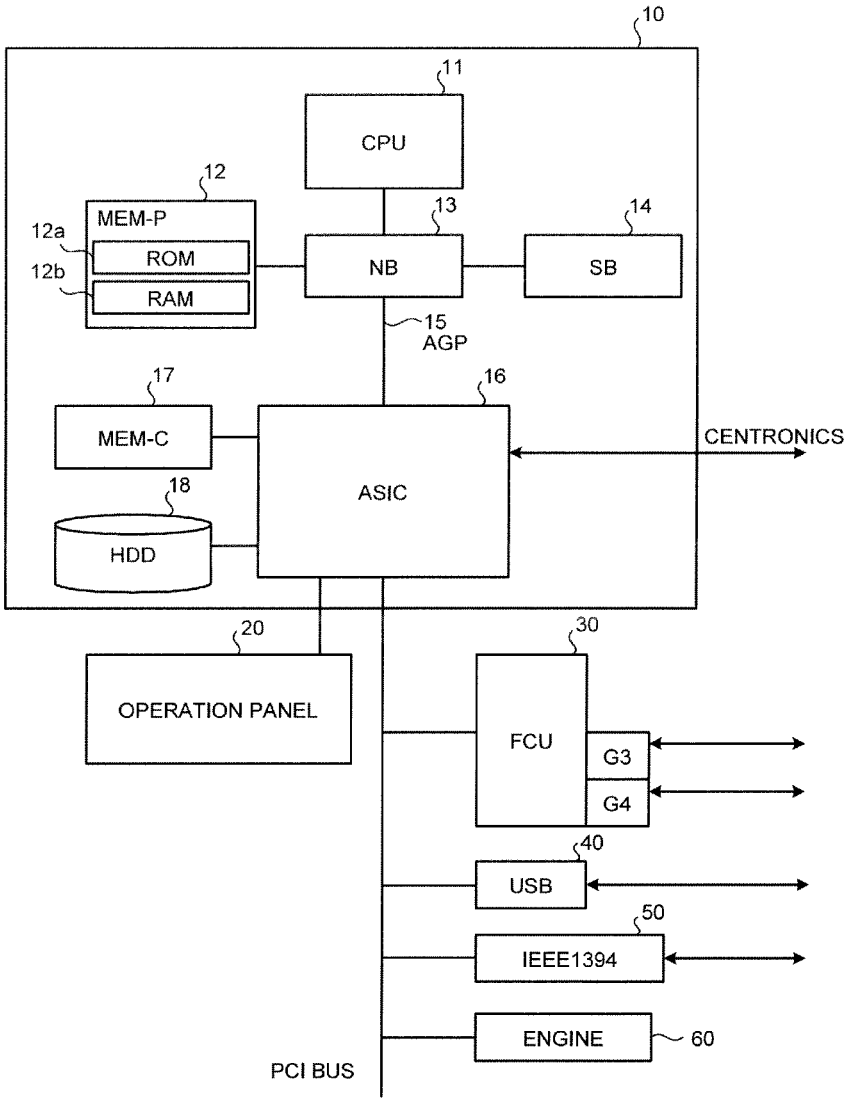
FIG. 9 is a block diagram depicting one example of a hardware configuration of the image forming device of the first to fourth embodiments.

FIG. 9 is a block diagram depicting an example of a hardware configuration of the image forming device 103 according to the first to fourth embodiments. As depicted in FIG. 9, this image forming device 103 has a controller 10 and an engine unit 60 connected to each other with a PCI (Peripheral Component Interface) bus. The controller 10 is a controller for controlling the entire image forming device 103, drawing (rendering), communication, and the input from an operation unit which is not illustrated. The engine unit 60 corresponds to a printer engine connectable to the PCI bus, and for example, a monochromatic plotter, a single-drum color plotter, a four-drum color plotter, a scanner, a facsimile unit, or the like is given. This engine unit 60 includes an image processing unit for error diffusion, gamma conversion, or the like in addition to a so-called engine unit such as plotter.

The controller 10 includes a CPU 11, a north bridge (NB) 13, a system memory (MEM-P) 12, a south bridge (SB) 14, a local memory (MEM-C) 17, an ASIC (Application Specific Integrated Circuit) 16, and a hard disk drive (HDD) 18. The north bridge (NB) 13 and the ASIC 16 are connected to each other with an Accelerated Graphics Port (AGP) 15. The MEM-P 12 further includes a read only memory (ROM) 12*a* and a random access memory (RAM) 12*b*.

The CPU 11 performs the entire control over the image forming device 103, includes a chip set including the NB 13, the MEM-P 12, and the SB 14, and is connected to another device via this chip set.

The NB 13 is a bridge for connecting the CPU 11 to the MEM-P 12, the SB 14, and the AGP 15, and includes a memory controller for controlling reading and writing relative to the MEM-P 12, a PCI master, and an AGP target.

The MEM-P 12 is a system memory used as a storage memory for a program or data, a memory for loading a program or data, or a rendering memory of a printer, and includes the ROM 12*a* and the RAM 12*b*. The ROM 12*a* is a read-only memory used as a storage memory for a program or data, and the RAM 12*b* is a memory capable of writing and reading used as a memory for loading a program or data, a drawing memory of a printer, or the like.

The SB 14 is a bridge for connecting the NB 13 to the PCI device and a peripheral device. This SB 14 is connected to the NB 13 via the PCI bus, and this PCI bus is connected to a network interface (I/F) unit and the like.

The ASIC 16 is an IC (Integrated Circuit) for image processing having a hardware element for image processing, and plays a role as a bridge for connecting the AGP 15, the PCI bus, the HDD 18, and the MEM-C 17. This ASIC 16 includes a PCI target and an AGP master, an arbiter (ARB) as a main element of the ASIC 16, a memory controller controlling the MEM-C 17, a plurality of DMACs (Direct Memory Access Controller) for, for example, rotating the image data with a hardware logic, etc., and a PCI unit for exchanging data with the engine unit 60 via the PCI bus.

This ASIC 16 is connected, via the PCI bus, to an FCU (Facsimile Control Unit) 30, a USB (Universal Serial Bus) 40, and an IEEE 1394 (the Institute of Electrical and Electronics Engineers 1394) interface 50. An operation panel 20 is directly connected to the ASIC 16.

The MEM-C 17 is a local memory used as an image buffer for copy, or a coding buffer. The HDD (Hard Disk Drive) 18 is a storage device for accumulating image data, accumulating programs, accumulating font data, and accumulating forms.

The AGP 15 is a bus interface for a graphics accelerator card, which is suggested for accelerating the graphic process, and accelerates the graphic accelerator card by directly accessing the MEM-P 12 at high throughput.

The image forming device 103 may be an MFP having at least two functions of a copying function, a printing function, a scanning function, and a facsimile function, or may be an image forming device such as a copier, a printer, a scanner device, a facsimile device, etc.

A program executed in the image forming device of this embodiment can be provided by being stored in a ROM, etc.

The program executed in the image forming device of this embodiment may be stored in a computer-readable storage medium such as a CD-ROM, a flexible disk (FD), a CD-R, or a DVD (Digital Versatile Disk) in the installable format file or executable format file and be provided as a computer program product.

Alternatively, the program executed in the image forming device of this embodiment may be stored on a computer connected to network such as the Internet and may be provided by being downloaded via the network. Further alternatively, the program executed in the image forming device of this embodiment may be provided or distributed via network such as Internet.

The program executed in the image forming device of this embodiment has a module configuration including the aforementioned units (calculating unit, notifying unit); in the actual hardware, the units are loaded on the main memory device when the CPU (processor) reads out the program from the ROM and executes the program, so that the units are generated on the main memory device.

Figure 10:
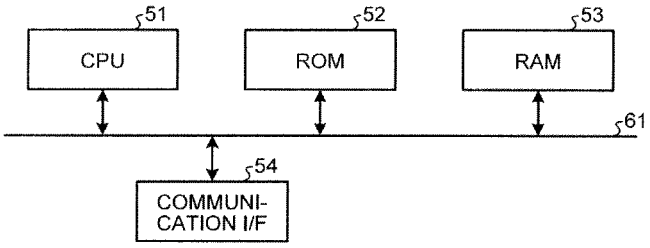
FIG. 10 is an explanatory diagram of one example of a hardware configuration of a host device and a mobile terminal of the first to fourth embodiments.

Next, the hardware configuration of the mobile terminal and the host device according to the first to fourth embodiments is described with reference to FIG. 10. FIG. 10 is an explanatory view depicting one example of the hardware configuration of the host device and the mobile terminal according to the first to fourth embodiments.

The host device and the mobile terminal according to the first to fourth embodiments include a control device such as a CPU (Central Processing Unit) 51, a memory device such as a ROM (Read Only Memory) 52 or a RAM (Random Access Memory) 53, a communication I/F 54 for performing communication by connection to network, and a bus 61 for connecting the units. Although not illustrated in FIG. 10, the host device and the mobile terminal may have a GPS receiving unit for receiving GPS signals from the GPS satellite 104.

According to the embodiments, the productivity of printing can be prevented from deteriorating.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device comprising:

a calculation unit configured to calculate, based on attribute information of a print job, a supply time point at which supply of consumables becomes necessary due to execution of the print job; and a notification unit configured to notify a user of necessity of the supply of the consumables at a time point obtained by subtracting a transit time it takes for the user to move to the image forming device and a supply time necessary for supplying the consumables from the supply time point.

2. The image forming device according to claim 1, wherein the user is a user who has requested the execution of the print job.

3. The image forming device according to claim 1, wherein the user is a predetermined manager.

4. The image forming device according to claim 1, wherein the user is a user who is closest to the image forming device.

5. The image forming device according to claim 1, wherein the calculation unit is configured to calculate the supply time point from a number of pages such that the supply of the consumables becoming necessary due to printing the number of pages and from print speed of one page.

6. The image forming device according to claim 5, wherein the consumables are toner; and the calculation unit is configured to calculate the number of pages based on an amount of toner consumption corresponding to a number of dots to be printed and an amount of remaining toner, and calculate the supply time point from the calculated number of pages and the print speed.

7. The image forming device according to claim 1, wherein the calculation unit is configured to calculate an end time point at which the execution of the print job ends; and the notification unit is configured to notify the user of the end of the print job at a time point obtained by subtracting the transit time from the end time point.

8. A method of notifying consumable exhaustion executed in an image forming device, the method comprising:

calculating, based on attribute information of a print job, a supply time point at which supply of consumables becomes necessary due to execution of the print job; and notifying a user of necessity of the supply of the consumables at a time point obtained by subtracting a transit time it takes for the user to move to the image forming device and a supply time necessary for supplying the consumables from the supply time point.

9. A non-transitory computer-readable storage medium with an executable program stored thereon, wherein the program instructs a computer to perform:

calculating, based on attribute information of a print job, a supply time point at which supply of consumables becomes necessary due to execution of the print job; and notifying a user of necessity of the supply of the consumables at a time point obtained by subtracting a transit time it takes for the user to move to the image forming device and a supply time necessary for supplying the consumables from the supply time point.

* * * * *